US005728980A

United States Patent [19]

Zarnick

[11] Patent Number: 5,728,980

[45] Date of Patent: Mar. 17, 1998

[54] DUCT SILENCER

[76] Inventor: Bernard Zarnick, 5309 Hamilton Ave., Cleveland, Ohio 44114-3908

[21] Appl. No.: 801,342

[22] Filed: Feb. 19, 1997

Related U.S. Application Data

[63] Continuation of Ser. No. 426,928, Apr. 21, 1995, abandoned.

[51] Int. Cl.[6] ..... E04F 17/04

[52] U.S. Cl. ..... 181/224

[58] Field of Search ..... 181/224, 229, 181/246, 264, 268, 291, 294; 285/331, 405, 415

[56] References Cited

U.S. PATENT DOCUMENTS

| | | | |
|---|---|---|---|
| 2,802,764 | 8/1957 | Slayter et al. | 181/291 |
| 3,726,359 | 4/1973 | Dierl et al. | 181/224 |
| 3,841,434 | 10/1974 | Culpepper, Jr. | 181/224 |
| 4,266,602 | 5/1981 | White et al. | 181/224 X |
| 4,558,892 | 12/1985 | Daw et al. | 285/331 |
| 5,165,730 | 11/1992 | McElroy | 285/405 X |

*Primary Examiner*—Khanh Dang

*Attorney, Agent, or Firm*—Fay, Sharpe, Beall, Fagan, Minnich & McKee

[57] ABSTRACT

A silencer for gas flowing through a duct includes a plurality of acoustical flat panels mounted in a duct and spaced from each other across the width of the duct. Each of the panels includes a core of rigid acoustical material encapsulated and heat sealed in polyvinyl fluoride to form opposed sides and opposed edges, all having smooth exterior surfaces.

6 Claims, 1 Drawing Sheet

DUCT SILENCER

This is a continuation application of Ser. No. 08/426,928, filed Apr. 21, 1995 now abandoned.

This invention relates to a plastic covered duct silencer adapted for an enclosed building in which ducts pass through the building carrying ambient air either hot or cold to make the rooms comfortable. Sometimes noise is carried from rooms or the heating plant in the air ducts to another room to the annoyance of the occupants.

It is known to put metal baffles in the ducts generally with perforations in the metal and sound absorbents with the metal.

This invention intends to use plastic encapsulated panels perhaps 5 to 15 in a typical duct. They are mounted to fit snugly longitudinally in the ducts generally parallel to one another in close proximity to each other, but not necessarily parallel. Thus, the air will pass between the panels.

These panels consist of a high density, rigid fiberglass core tightly encapsulated in a covering of PVF (polyvinylfluoride), 1–5 mils thick, or other suitable plastic. The pulse of air and noise generally will dissipate against the pliant surface of the plastic covered panels, thus reducing the noise level and improving the acoustical transparency index and preventing sound from passing from one room to another. This will create a better acoustical environment for the occupants.

These duct silencers consisting of encapsulated panels will lower the air-flow resistance compared to perforated metal baffles. Additionally, the air would be cleaner and have less contamination than conventional silencers and be less apt to collect lint and dust than perforated baffles do.

These encapsulated panels have two pliant surfaces each and air will pass between the panels, resulting in better absorption because the acoustical transparency index is improved as compared with prior art conventional silencers.

Since there are no perforations in the panels, the flow of air is smooth i.e. laminar as much as possible and does not introduce whistling noises or air flow resistance.

Smaller ducts may be substituted when encapsulated panels line the duct in contrast to traditional rough surfaced duct liners and metal.

Having thus described the features, I will describe them in more detail with the following drawings in which:

Figure 1:
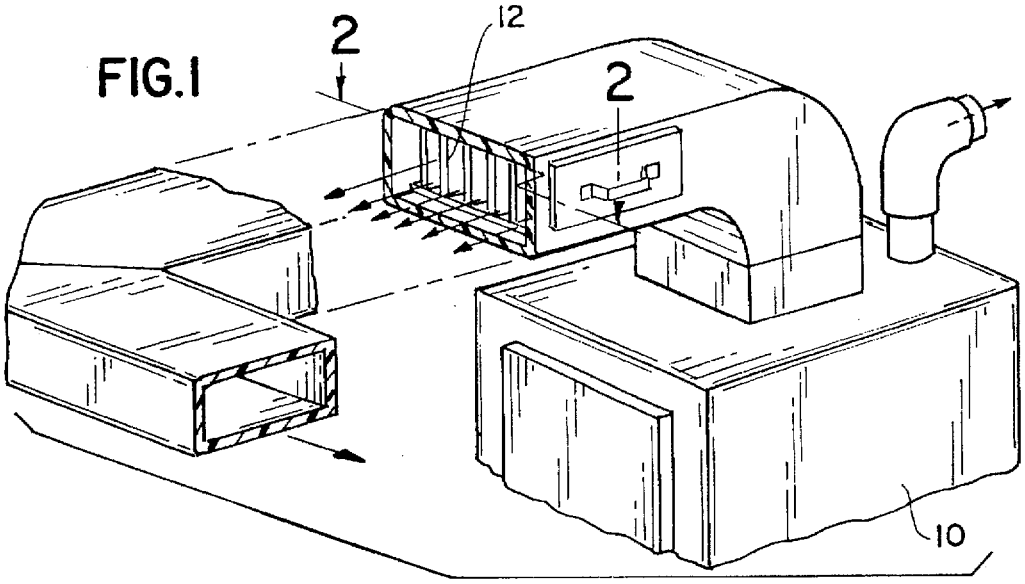
FIG. 1 is a view of a heating plant and the duct leading to rooms of the building.
Figure 2:
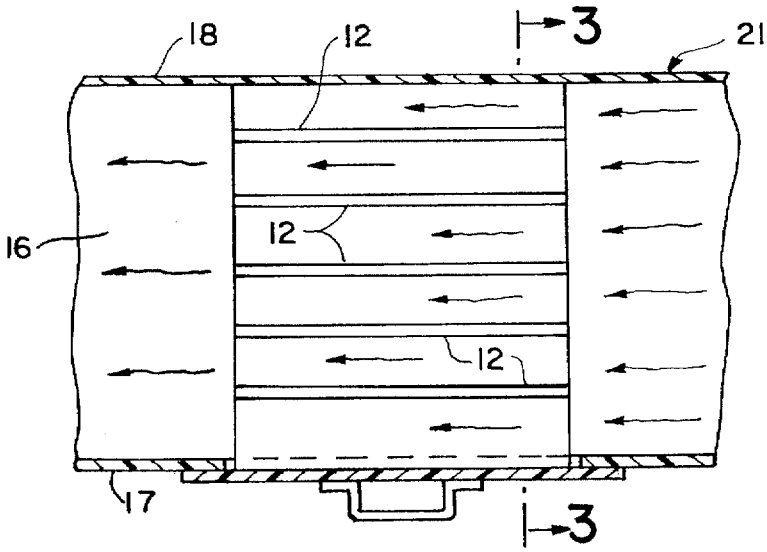
FIG. 2 is a cross section along the lines 2—2 of FIG. 1.
Figure 3A:
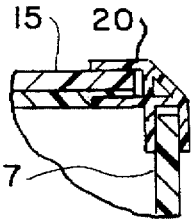
FIG. 3*a* is an enlarged cross section of a corner.
Figure 3:
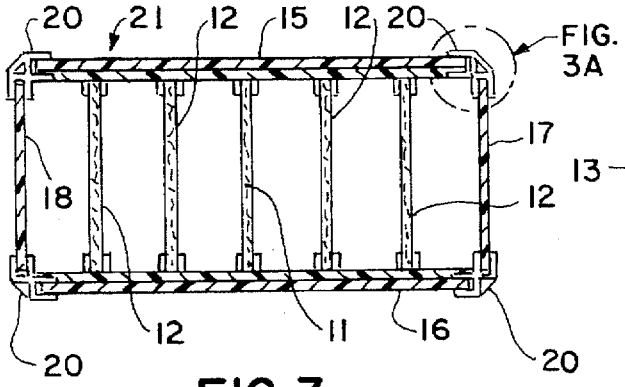
FIG. 3 is a cross section along the lines 3—3 of FIG. 2 showing a cross section of the duct silencer panels.
Figure 4:
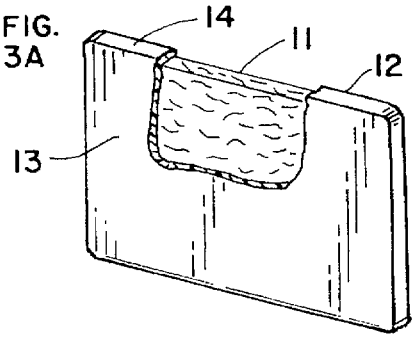
FIG. 4 is an exploded view of a duct silencer panel showing the fiberglass and cover.

In all modern buildings, there is a heating and ventilating system (10) that has some noise and vibration that extends the entire range of audible frequencies e.g. 64–8000 cps. These annoy occupants in a remote place from the source. As a consequence, heating and ventilating engineers have utilized perforated metal baffles to reduce the noise. Still these are did catchers and whistle at times. I propose to make a duct silencer of plastic panels (12), each of which has core of fiberglass (11) or other rigid acoustical core material and a covering for the rectangular panel comprised of a suitable film (13) and (14) 1–5 mils thick of PVF (polyvinylfluoride) or other suitable plastic such as poly vinyl chloride. The film is heat sealed over the core and has a smooth exterior surface on the sides and edges.

The fiberglass core or rigid acoustical core material (11) has a hard edge on the peripheral edges to allow the panels to be fixedly placed in the ducts.

The duct in which the panels are placed could also be made of the same type of panels and 4 panels (15), (16), (17), and (18) are formed into a duct with the use of molded plastic corners (20). This duct structure enhances the overall performance by combining the lined duct with the silencer. Each corner is formed from PVC (polyvinyl chloride) with 2 U-shaped members formed at 90 degrees to each other. These corners are secured to the panels to form a rectangular duct 21 for the silencers.

Preferable the duct silencers would be placed in a duct at a position downstream from the furnace plenum or fan. Noise would attenuate further if the duct following the silencer were lined with absorbent panels. Thus, I have explained my invention and its principle features and I do not want to be limited more than my claims which follow:

I claim:

1. A silencer for gas flowing through a duct comprising:

a plurality of acoustical flat panels mounted in a duct and spaced from each other across the width of the duct;

each of said panels comprising a core of rigid acoustical material encapsulated and heat sealed in polyvinyl fluoride to form opposed sides and opposed edges, all having smooth exterior surfaces.

2. The silencer of claim 1, wherein the opposed sides of polyvinyl fluoride are sufficiently pliant to flex when gas flows thereover.

3. The silencer of claim 1, wherein the rigid acoustical material is comprised of fiberglass.

4. A silencer for flowing gas comprising:

a rectangular duct comprised of a plurality of connected acoustical wall panels; and a plurality of acoustical flat panels mounted in said duct and spaced from each other across the width of said duct;

each of said wall panels and said flat panels comprising a core of rigid acoustical material encapsulated and heat sealed in polyvinyl fluoride to form opposed sides and opposed edges, all having smooth exterior surfaces.

5. The silencer of claim 4, wherein the opposed sides of polyvinyl fluoride are sufficiently pliant to flex when gas flows thereover.

6. The silencer of claim 4, wherein the rigid acoustical material is comprised of fiberglass.

* * * * *